US007999223B2

(12) United States Patent
Makarov et al.

(10) Patent No.: US 7,999,223 B2
(45) Date of Patent: Aug. 16, 2011

(54) MULTIPLE ION ISOLATION IN MULTI-REFLECTION SYSTEMS

(75) Inventors: Alexander Alekseevich Makarov, Bremen (DE); Anastassios Giannakopulos, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 162 days.

(21) Appl. No.: 12/514,683

(22) PCT Filed: Nov. 14, 2007

(86) PCT No.: PCT/GB2007/004352

§ 371 (c)(1),
(2), (4) Date: May 13, 2009

(87) PCT Pub. No.: WO2008/059246

PCT Pub. Date: May 22, 2008

(65) Prior Publication Data

US 2010/0059673 A1 Mar. 11, 2010

(51) Int. Cl.
*H01J 49/06* (2006.01)
*H01J 49/26* (2006.01)
*H01J 49/40* (2006.01)

(52) U.S. Cl. ..... 250/290; 250/281; 250/282; 250/284; 250/287; 250/288; 250/292

(58) Field of Classification Search ..... 250/281, 250/282, 283, 284, 287, 288, 290, 292
See application file for complete search history.

(56) References Cited

U.S. PATENT DOCUMENTS

| | | | | |
|---|---|---|---|---|
| 5,371,364 | A * | 12/1994 | Davies et al. | 250/287 |
| 5,619,034 | A * | 4/1997 | Reed et al. | 250/287 |
| 6,888,130 | B1 * | 5/2005 | Gonin | 250/287 |
| 7,038,198 | B2 * | 5/2006 | Yamaguchi et al. | 250/287 |
| 7,081,617 | B2 * | 7/2006 | McLean et al. | 250/283 |
| 7,148,473 | B2 * | 12/2006 | Yamaguchi et al. | 250/287 |
| 7,211,792 | B2 * | 5/2007 | Yamaguchi et al. | 250/287 |
| 7,385,187 | B2 * | 6/2008 | Verentchikov et al. | 250/287 |
| 7,403,113 | B2 * | 7/2008 | Moon et al. | 340/539.22 |
| 7,407,796 | B2 * | 8/2008 | Hammerstedt et al. | 435/287.2 |
| 7,446,312 | B2 * | 11/2008 | Rather | 250/288 |
| 7,579,589 | B2 * | 8/2009 | Miller et al. | 250/292 |
| 7,608,818 | B2 * | 10/2009 | Miller et al. | 250/288 |
| 7,789,943 | B2 * | 9/2010 | Zhou et al. | 95/116 |
| 2005/0045817 | A1 * | 3/2005 | Yamaguchi et al. | 250/287 |
| 2005/0077461 | A1 | 4/2005 | Yamaguchi et al. | |
| 2005/0151076 | A1 | 7/2005 | Yamaguchi et al. | |
| 2007/0051886 | A1 * | 3/2007 | Rather | 250/288 |
| 2007/0084998 | A1 * | 4/2007 | Franzen et al. | 250/287 |
| 2007/0272852 | A1 * | 11/2007 | Miller et al. | 250/288 |

(Continued)

OTHER PUBLICATIONS

E. W. Blauth, "Dynamic Mass Spectrometers," XP002519722, Elsevier (Amsterdam), pp. 114-116, (1966), pp. 114-116, (1966).

*Primary Examiner* — David A Vanore
(74) *Attorney, Agent, or Firm* — Charles B. Katz

(57) ABSTRACT

This invention relates to a method of operating a charged particle trap in which ions undergo multiple reflections back and forth and/or follow a closed orbit around, usually, a set of electrodes. The invention allows high-performance isolation of multiple ion species for subsequent detection or fragmentation by deflecting ions out of the ion trap according to a timing scheme calculated with reference to the ions' periods of oscillation within the ion trap.

60 Claims, 7 Drawing Sheets

U.S. PATENT DOCUMENTS

2008/0184881 A1* 8/2008 Zhou et al. ..... 95/43
2009/0023203 A1* 1/2009 Hammerstedt et al. .... 435/288.7
2009/0189064 A1* 7/2009 Miller et al. ..... 250/282
2010/0059673 A1* 3/2010 Makarov et al. ..... 250/283

* cited by examiner

MULTIPLE ION ISOLATION IN MULTI-REFLECTION SYSTEMS

FIELD OF THE INVENTION

This invention relates to a charged particle trap in which ions undergo multiple reflections back and forth and/or follow a closed orbit under the influence of a set of electrodes. The invention also relates in particular to a method of operating such a trap and allows high-performance isolation of multiple ion species for subsequent detection or fragmentation.

BACKGROUND OF THE INVENTION

There are currently many known arrangements and techniques for trapping or storing charged particles for the purposes of mass spectrometry. In some such arrangements, for example 3-D RF traps, linear multipole RF traps, and the more recently developed "Orbitrap", ions injected into or formed within the trap oscillate within the trap with simple harmonic motion. In that case, ions may be selected for onward transmission to other traps, for mass analysis/detection, and so forth, by applying oscillating fields to the trap. This is because all of the ions of a given mass to charge ratio within the trap have a secular frequency of oscillation, such that ions of a specific mass to charge ratio may be resonantly excited out of the trap through application of a time-varying field to the whole of the trap.

In other multi-reflection systems, however, ions do not undergo simple harmonic motion. One example of such a trap is an electrostatic trap with two opposing reflectors. In such a trap, ions repeatedly traverse a space under the action of a field or fields and are reflected by at least two ion reflectors. In this type of trap, the application of an oscillating field will not select ions of just one mass to charge ratio. This is because ions of one mass to charge ratio are oscillating in the trap with a range of frequency components, not just one as they would if oscillating with simple harmonic motion. Whilst the ions of each mass to charge ratio have a unique period of oscillation, they do not oscillate with sinusoidal motion, and they can be excited by sinusoidal time varying fields which have a range of frequencies. Because of this, application of a single frequency sinusoidal excitation field to the trap will excite ions with a range of mass to charge ratios and cannot be used to select ions with high mass resolution.

Even though ions of different mass to charge ratios may have similar frequency components, they will, as noted above, nevertheless have a unique period of oscillation in the trap. In other words, ions of mass to charge ratio $(m/z)_1$ will pass a notional point in the trap at times $t_1, t_2, t_3, t_4 \ldots$, where $(t_2-t_1)=(t_3-t_2)=(t_4-t_3) \ldots$ whereas ions of a different species having mass to charge ratio $(m/z)_2$ will pass the same point at times $t_a, t_b, t_d \ldots$, where $(t_b-t_a)=(t_c-t_b)=(t_d-t_c) \ldots$ but where $(t_b-t_a)$ does not equal $(t_2-t_1)$.

Therefore, by applying an excitation field to a specific localised part of the trap, at a particular time, ions of a given mass to charge ratio can be excited. Whilst it is possible to excite only the ions of interest (that is, only the ions having the desired mass to charge ratio m/z), in the practice normally the inverse of this is employed, and the excitation field is applied to all ions except those having the mass to charge ratio of interest, such that unwanted ions are excited out of the trap or so that they collide with a structure in the trap and are lost. Repeatedly turning the excitation field off, each time the ions of interest are in the excitation region, narrows the mass to charge ratio range of ions that are within the trap. Ions of a single, narrow, range of mass to charge ratios are selected in this way. The excitation field is usually generated by applying a voltage pulse to a deflector electrode which is positioned close to the ion path within the trap.

A typical prior art reflection trap employing such a principle is described in U.S. Pat. No. 3,226,543. Here, positive ions travel between two positively biased reflection electrodes forming a reflection trap. One of the reflection electrodes has the positive reflecting bias applied only when ions of a desired mass to charge ratio reach it, all other ions then passing through the de-energized reflector so that they are lost. A similar reflection trap is described in U.S. Pat. No. 6,013,913; opposing reflection electrodes are provided and one of these is unbiased during a particular time interval to allow desired ions to pass through the reflector and reach a detector. In U.S. Pat. No. 6,013,913, in order to improve transmission, an electrostatic particle guide is employed between the opposing reflectors. This guide also allows selective ejection of ions from the ion flight path.

Higher and higher mass to charge ratio resolution can be achieved using the repeated excitation techniques described above, provided only that the ions oscillate isochronously and can be held in the trap for sufficiently long periods of time. Both of these requirements are usually limited by ion optical imperfections of the trap, which set a limit on the useful time period—there is nothing further to be gained in continuing to oscillate the ions once the resolution limit of the trap has been reached. Additional oscillations simply expose the ions to further scattering events with background gas in the trap. Typically, the time limit is of the order of several, to several hundred milliseconds.

In some prior art systems, such as the one described in the above-referenced U.S. Pat. No. 6,888,130, the trap may optionally on occasion be operated at relatively low mass to charge resolution, and ions over a continuous but relatively large mass to charge ratio range are selected and ejected in one stage for further processing or detection.

Prior art methods of ion ejection suffer from a serious disadvantage, in that ions of only one mass to charge ratio (at high resolution), or ions of a continuous range of adjacent mass to charge ratios (at low resolution) are selected at a time. At high resolution, only one ion species can be selected during every fill of the trap, that is, only one ion species in each useful time-period may be analysed. For a single MS/MS experiment, in which a parent ion is to be selected, this might be all that is required. However, to acquire an extended mass spectrum at high resolution or multiple MS/MS experiments would require a great many trap fills, and a long elapsed time. If the sample material to be analysed is limited, it might be that only a small mass range could be analysed using this method. In the case of low resolution mass detection of a range of adjacent mass to charge ratios, there is an additional problem. In the next stage of processing or detection, the response time of a typical high dynamic range detector (formed by a charged particle multiplier detection system such as a channeltron or electron multiplier with an array of dynodes) is of the order of 1-10 microseconds. Specialized detectors for time-of-flight mass spectrometers are capable of shorter response times, although their dynamic range is typically much lower. This is caused by the fact that peak current in such detectors is comparable to that in slower, traditional detectors whilst the duration of the mass peak (and hence total charge detected) is much smaller. The typical pulse width of a packet of ions exiting the multi-reflection trap is of the order of 20-100 ns. This is several orders of magnitude shorter than the response time of typical detectors and thus limits resolution of ions of adjacent mass to charge ratios of significantly differing abundances.

SUMMARY OF THE INVENTION

Against this background, and in accordance with a first aspect of the present invention, there is provided a method of operating a multi-reflection or closed orbit ion trap assembly, comprising the steps of: (a) identifying a plurality n(≧2) of ion species of interest from a superset of ion species injected into, or formed within, an ion trap, each of which identified species undergoes substantially isochronous oscillations or orbits along a path within the ion trap, the oscillations or orbits having a period characteristic of the respective mass to charge ratio $m/z_n$ of that species and which period is distinct for each of the said n identified species; (b) switching an ion gate located in or adjacent the ion trap between a first gating state in which ions of the identified species passing along the path within the ion trap are directed along a first ion path, and a second gating state in which ions not of the identified species passing along the path within the ion trap are directed along a second, different path; wherein the ion gate is switched into the said first gating state at a plurality of times T, a first subset of which times, $T_a$(a≧1) being determined by the characteristic period of ions of a first of the n identified species of interest, a second subset of which times, $T_b$(b≧1) being distinct from the first subset and being determined by the different characteristic period of ions of a second of the n identified species of interest, and so forth for any further (n−2) of the n identified species of interest; whereby the ions of those species identified to be of interest are separated from those ions not so identified.

By ion trap, any device that constrains the ions to follow the defined oscillatory or orbital path is contemplated. Thus, the trap should be operable to constrain the ions to make repeated circuits of the oscillatory or orbital path within the trap. A convenient choice for the ion trap is an electrostatic trap, although alternatives will be evident to the person skilled in the art.

The ion gate may be a selectively actuatable ion deflector, and may use electrostatic or electromagnetic deflection. The ion gate may be located in the ion trap itself or may be adjacent the ion trap. Its position should be such that it can act to direct ions travelling along the path within the ion trap to follow either the first or second path. One of these paths may simply be a continuation along the path within the ion trap, i.e. in one state the ion gate may deflect ions away from the path within the ion trap and in the other state the ion gate may leave the ions undeflected to continue following the path within the ion trap.

By identifying ion species in the trap having different characteristic periods, and having a knowledge of those periods, the ion trap assembly can be operated to separate the ions of the species of interest from those not of interest by operating the ion gate at appropriate times. For example, the ion gate may be an electrostatic deflector which is energised so as to deflect ions of species not of interest, the ion gate being de-energized at the known, specific times when the ions of the species of interest in the vicinity of the ion gate only. The ions of species not of interest may be deflected onto the walls of the electrostatic trap or ejected from the trap. If they are ejected from the trap, they can, optionally, be stored in an external storage device, for re-injection into the trap in a subsequent cycle and for subsequent analysis then. Alternatively they can be sent for further processing by other devices, such as fragmentation.

The ion gate may be generally geometrically centrally located within the trap so that ions typically traverse each "half" of the trap in essentially the same periods (each T/2). In that case, the ion gate is configured to switch twice per oscillation (as each ion passes the ion gate twice per oscillation). Alternatively, the ion gate may be offset so that the ion gate still switches twice per oscillation but the time between the two switches is unequal for a given ion species. In other trap designs, ions might only pass the ion gate once per oscillation or orbital cycle.

Because the period of oscillation of the different ion species is known beforehand, an algorithm can be used to optimise the separation of the ions. For example, to construct a mass spectrum, a list of single ion species to be selected is formed. Knowledge of the period of each of the identified species, at their known kinetic energies, may then be employed to calculate several sets of the species to be selected. In each set, species which have mass to charge ratios such that they pass the ion gate at quite different times are chosen. For example, the period of the ions injected into or formed within the trap, and the identification, on that basis, of how best to separate the identified species into sets may be obtained from a calibration sample ion set.

By taking this approach, ion species within any one set can be selected with just one fill of the trap. Rather than wasting the remaining ions (of which some will be of interest but will have been allocated by the algorithm to different sets), they may be stored externally as explained above for re-injection into the trap and analysis in subsequent cycles.

Although ions of different mass to charge ratios will have different periods, nevertheless ions of two or more different species may arrive at the ion gate at substantially the same time on occasion, as a consequence of one of the packets of ions having undergone a different number of oscillations. For example, if ions of mass to charge ratio $(m/z)_1$ have a period of oscillation $T_1$, and ions of mass to charge ratio $(m/z)_2$ have a period of oscillation $T_2$, then where both ion packets start off at the same place, and at the same time, they will coincide at that place at a time when $nxT_1=kxT_2$ (where n, k are integers at least).

This allows for flexible ion ejection and analysis. If only a single ion species is to be ejected for analysis, then an algorithm can be employed to identify a time where ions of only that specific identified species (and no others) are at the ion gate. If multiple ion species are to be analysed simultaneously, however, then the algorithm can determine a time when both or each of those ion species will be at the ion gate simultaneously. Even for single species the algorithm should be run iteratively, that is, unused parts of the mass range are discarded as soon as possible to avoid increase of background and interferences.

In accordance with a further aspect of the present invention, there is provided a multi-reflection or closed orbit ion trap assembly, comprising: an ion trap; an electrode arrangement including an ion gate, the ion gate being switchable between a first gating state wherein ions, when following a path within the ion trap, are directed along a first ion path, and a second gating state wherein ions, when following a path within the ion trap, are directed along a second ion path; and a trap controller arranged to permit identification, from within a plurality of species of charged particles introduced into, or formed within the ion trap, a plurality n(≧2) of ion species of interest each of which n identified ion species undergoes substantially isochronous oscillations or orbits along the path within the ion trap, the oscillations or orbits having period characteristic of the respective mass to charge ratio $m/z_n$ of that species, and which period is distinct for each of said n identified species the trap controller being further arranged to switch the ion gate into the first gating state at a plurality of times T, a first subset of which times, $T_a(a \geqq 1)$ being determined by the characteristic period of ions of a first of the n identified-species of interest, a second subset of which times, $T_b(b \geqq 1)$ being distinct from the first subset and being determined by the different characteristic period of ions of a second of the n identified species of interest, and so forth for any further (n−2) of the n identified species of interest; whereby the ions of those species identified to be of interest are separated from those ions not so identified.

By ion trap, any device that constrains the ions to follow the defined oscillatory or orbital path is contemplated. Thus, the trap should be operable to constrain the ions to make repeated circuits of the oscillatory or orbital path within the trap. A convenient choice for the ion trap is an electrostatic trap, although alternatives will be evident to the person skilled in the art.

The ion gate may be located in the ion trap itself or may be adjacent the ion trap. Its position should be such that it can act to direct ions travelling along the path within the ion trap to follow either the first or second path. One of these paths may simply be a continuation along the path within the ion trap, i.e. in one state the ion gate may deflect ions away from the path within the ion trap and in the other state the ion gate may leave the ions undeflected to continue following the path within the ion trap.

The invention also extends to a mass spectrometer including such an ion trap assembly, which mass spectrometer may, in addition to the ion trap, additionally comprise one or more of an external ion storage device for storing ions for analysis in subsequent cycles, and/or an ion detection arrangement, which may be internal to or external of the trap, and/or an ion source for generating charged particles, and/or an ion storage and injection device positioned between the ion source and the trap. Moreover, this invention could be employed for precursor mass selection for MS/MS and $MS^n$ analysis, wherein subsequent fragmentation and mass analysis is carried out either in an external fragmentation cell and mass spectrometer, or even in a pre-trap and/or in the multi-reflection or closed orbit ion trap.

Interference-free fragmentation of multiple ion species of interest could be implemented by ejecting each of them sequentially into the fragmentation cell with a separation in time that is greater than the width of distributions of residence times of these species and their fragments in the fragmentation cell. Multiple ion species of interest may be ejected into the fragmentation cell together for fragmenting as a single batch. Alternatively, each of the species of interest could be diverted into its own dedicated cell for fragmentation and/or trapping which would allow a reduction in the required separation in time, and also allow parallel processing of all these species.

In accordance with another aspect of the present invention, there is provided a method of operating a multi-reflection or closed orbit electrostatic ion trap, comprising the steps of: (a) injecting a plurality of charged particles, having a range of mass to charge ratios into the electrostatic trap; (b) identifying, from within the injected range, a plurality $n(\geqq 2)$ of ion species for analysis, each of which n identified species undergoes substantially isochronous oscillations having a characteristic period of oscillation past a given point in the trap that is distinct from the characteristic period of oscillation of the other identified species past that point in the trap; (c) switching an ion gate, located at gating position, between a first gating state in which ions of the identified species passing through that point in the trap are directed along a first ion path, and a second gating state in which ions not of the identified species passing through that point in the trap are directed along a second, different ion path; wherein the ion gate is switched into the said first gating state at a plurality of times each of which is related to the distinct characteristic frequency of oscillation of a respective one of the identified species, so as to separate the identified species from those not identified; and (d) detecting the identified ion species.

It is to be stressed that the present invention is equally applicable to any type of trap in which charged particles undergo multiple anharmonic oscillations. Thus, in particular, the invention is applicable to linear electrostatic traps with two ion mirrors (such as is described in, for example, the above-referenced U.S. Pat. No. 3,226,543 and U.S. Pat. No. 6,013,913), sector electrostatic traps with multiple sectors, such as, for example, in US-A-2005/0151076, spiral electrostatic traps such as are described in SU-A-1,716,922, either closed (that is, the same path is traversed during consecutive reflections such as the FIG. 8 flight path shown in U.S. Pat. No. 6,300,625) or open (that is, ions follow similar but not exactly overlapping paths, as shown in GB-2,080,021). It can also be applied to traps in which ions undergo harmonic oscillations, although other methods for exciting ions exist for these types of trap.

Further features and advantages of the present invention will be apparent from the appended claims and the following description.

DETAILED DESCRIPTION OF A PREFERRED EMBODIMENT

Figure 1A:
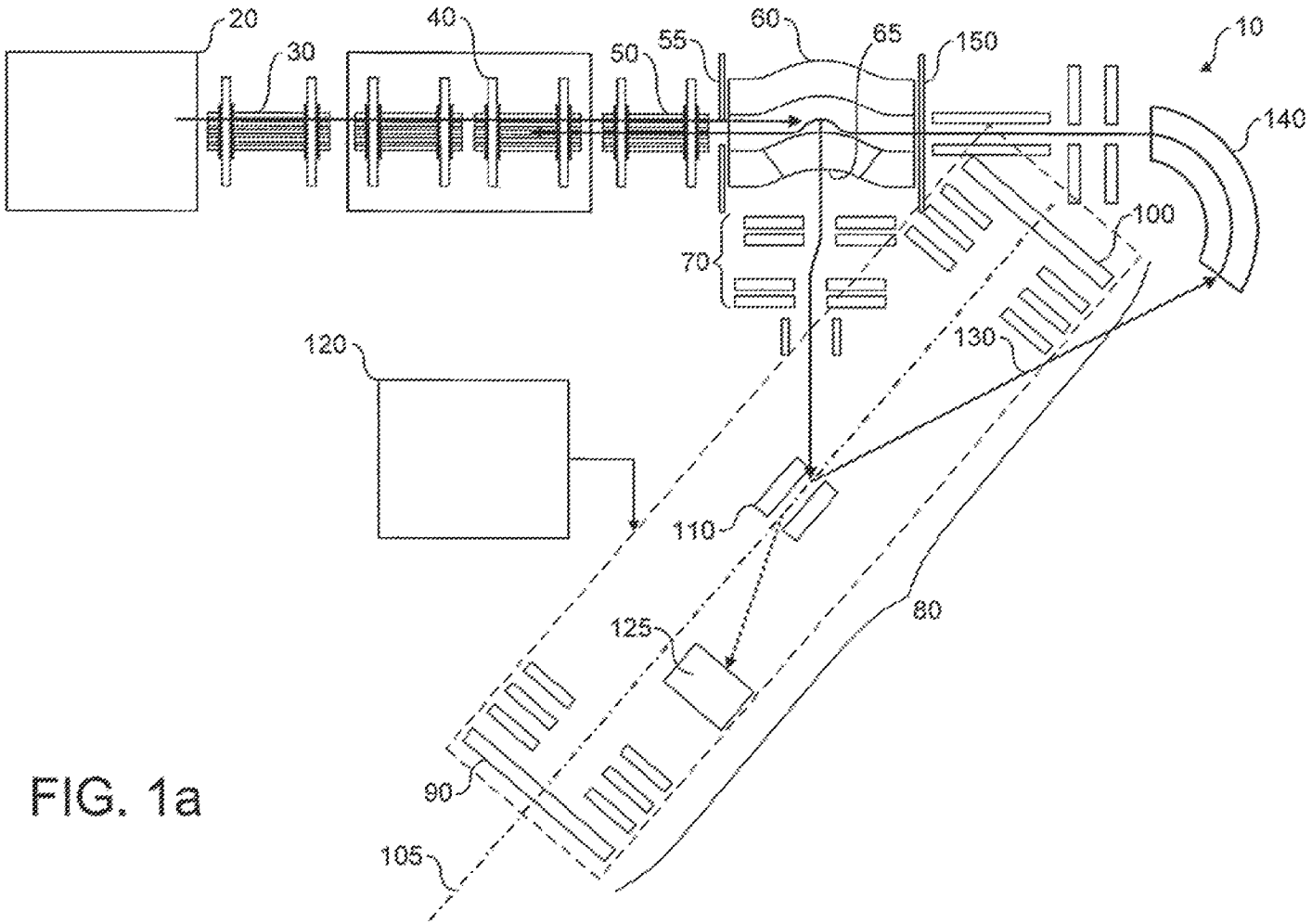
FIG. 1*a* shows an exemplary embodiment of a mass spectrometer including a multi-reflection or closed orbit electrostatic ion trap which is illustrative of the present invention and which includes an ion deflector.

FIG. 1*a* shows an embodiment of a mass spectrometer 10 in accordance with the present invention. The mass spectrometer comprises an external ionisation source 20, such as an electrospray ion source or a MALDI ion source, which generates a continuous or pulsed stream of charged particles to be analysed. The charged particles pass through first ion optics 30 and into a pre-trap 40. The ions are confined in the pre-trap 40 to permit accumulation of ions from the ion source 20, after which they are injected into an rf-only injection trap 60, via second ion optics 50. The injection trap 60 may be a linear quadrupole trap, a linear octapole trap, and so forth. In the preferred embodiment, however, a curved linear trap, preferably with rf switching, is employed. This trap receives ions from the pre-trap 40 through a first entrance aperture 55, stores them in the curved linear trap, and then ejects them orthogonally through an ion exit aperture 65. Ions leaving the ion exit aperture 65 pass through trap optics 70 and are injected into an electrostatic trap (EST) shown generally at 80 in FIG. 1*a*, through an entrance aperture in the EST (not shown in FIG. 1*a*). The ions arrive at the electrostatic trap in a well-defined, short time period. Once in the EST 80, the ions commence oscillatory motion within the trap 80, between first and second reflecting electrodes 90, 100. The ions oscillate back and forth within the EST 80 along the axis 105 of the EST 80, shown in FIG. 1, between the first and second reflecting electrodes 90, 100.

Located within the EST 80 is a modulator/deflector 110. In FIG. 1*a*, this is shown schematically to be located within the EST 80 along the path 105 that the ions follow as they oscillate within the EST 80, approximately equidistant from the two reflecting electrodes 90, 100. It will be understood that the modulator/deflector 110 could however be located elsewhere within or adjacent the EST 80 and, in particular, at an off axis or non-equidistant location relative to the reflecting electrodes 90, 100. Wherever located, the modulator/deflector 110 should be operable to deflect or otherwise steer ions as they oscillate along the path 105 within the EST 80.

The modulator/deflector 110 serves several purposes. Firstly, it acts as an ion gate, allowing selective deflection or diversion of ions out of the path of oscillation 105 within the EST 80, in accordance with a timing scheme to be explained in more detail in connection with FIGS. 2*a*-2*d* below. The other purpose of the modulator/deflector 110 is to set or control the energy of ions entering the EST 80, as follows.

Motion within the EST 80 can be induced in various ways. In a first way, ions enter the EST 80 through the EST entrance which is in turn located at a point where the field strength within the EST 80 is sufficiently large to commence oscillatory motion. One way to achieve this is to position the entrance to the EST 80 at a location at which the field strength within the EST 80 is sufficiently large to set the ions in oscillatory motion as a consequence of the electric field the ions experience as they enter the EST 80. In an alternative method, the ions are injected into the EST 80 with the necessary kinetic energy so that they commence oscillatory motion without requiring further acceleration within the EST 80 by application of an accelerating electric field.

In still a further method, ions are provided with kinetic energy once in the EST 80, by applying a field immediately after the ions have entered the EST 80. This may, for example, be achieved by energising the modulator/deflector 110, as indicated in FIG. 1*a*.

In each case, the average kinetic energy of the ions within the EST 80 is known.

Of the various ion species injected into the EST 80 from the injection trap 60, a sub-set of species to be analysed is identified. In one embodiment, a specific discrete set of ion species (for example, across a wide mass to charge ratio range) is identified—that is, a plurality of discrete ion species is selected. Alternatively, upper and lower limits to a defined mass to charge ratio range may be selected, with all species within that range being selected. It will be appreciated that, to an extent, this amounts to the same, in that it is necessary either way to identify the specific mass to charge ratio of each ion species of interest. However, the manner in which the ions are handled in the EST 80 once identified may differ slightly depending upon the proximity of each ion species to the others in the selected set, in terms of mass number and/or depending on ion number.

Either way, once the multiple ion species of interest have been identified, a trap controller 120, connected to the EST 80 and including a processor, uses the known oscillation period of each of the ion species of interest, at their known kinetic energies, to calculate an optimised separation and analysis procedure. A preferred embodiment of an algorithm to do this is described in detail in connection with FIGS. 3*a*-3*c* below. However, to allow an understanding of the hardware operation, a brief overview is now provided.

In simplest embodiments, when only a small number of ion species (for example, two or three) are to be analysed from a single fill of the EST 80, no sub-division of the total number of selected ion species is necessary as a rule. On the other hand where a larger number of ion species is to be analysed, the trap controller 120 determines an optimal sub-set of the ion species of interest, based upon a separation in period of the ions of interest. For example, if fifteen different ion species are to be analysed, the trap controller 120 may identify, for example, five of those fifteen species which have widely differing periods of oscillation such that, rapidly, they will separate within the EST when injected from the injection trap 60 simultaneously. As will be explained below, the remaining twelve of the fifteen identified species in that case can be stored externally of the EST 80 for re-injection in subsequent cycles, again suitably sub-divided as appropriate and as decided by the trap controller algorithm.

For simplicity of explanation, the following description assumes that, of all of the different ion species initially injected into the EST 80 from the injection trap 60, only three species are ultimately of interest. Also the assumption is made that each of these three ion species contains ions that undergo oscillations having quite different periods of oscillation, so that they are readily separable. Nevertheless, it is to be understood that more complicated and overlapping sets of ion species can equally be considered in accordance with the present invention.

In the present example, to separate the three ion species of interest from the remaining ions, the trap controller 120 calculates the elapsed times at which each of the ions of the species of interest will be in the vicinity of the modulator/deflector 110. The modulator/deflector 110 (following injection and, where necessary, acceleration in the EST 80) is, in the preferred embodiment, controlled by the trap controller 120 so as to deflect each of the ions in species not of interest away from the ion oscillation path 105. However, for those ions of species which are of interest, the modulator/deflector 110 is switched, under the control of the trap controller 120, so that it is de-energised at the time when ions of those species of interest are in the vicinity of it. Thus, ions of species of interest continue along the path 105 and are reflected by the reflectors 90, 100, whereas all other ions are deflected/directed out of that path 105. After a number of oscillations in the EST 80, only ions of the species of interest continue to oscillate back and forth along the path 105, the remaining ions of species not of interest having been removed.

In the presently preferred embodiment, the modulator/deflector 110 is continuously energised save for those times when the ions of species that are of interest are in the vicinity of it. Of course, assuming that all of the ion species injected into the electrostatic trap 80 are known beforehand, it would be possible to operate the EST 80 the other way round, that is, to have the modulator/deflector 110 de-energised at all times, except when ions of all of the species not of interest are in the vicinity of it, when it is energised in order to move those ions of species not of interest out of the path 105. Moreover, whilst the foregoing simply describes energising and de-energising the modulator/deflector 110, it would equally be possible to have that modulator/deflector 110 energised at all times, though with different voltages, so that ions of those species of interest are deflected or diverted along a first path (which differs from the path along which they have been travelling upon arrival at the modulator/deflector 110), but where those ions are of course saved, whereas the ions of those species not of interest are diverted along a second path such that they are separated out from the ions of the species of interest.

Adjacent ion packets can be separated in time from tens of nanoseconds to even tens of microseconds. Since iso-mass ion packets have temporal widths in the order of a few tens of nanoseconds, selection of ion species of interest is not limited by the response of electronics but rather by the physical dimensions of the device used for isolation, i.e. the modulator/deflector 110. For example, a 1000 Da ion packet with 20 nsec pulse width at 10 keV kinetic energy will have a spatial size of 0.89 mm. Therefore, the modulator/deflector 110 should ideally have a similar size which conflicts with much greater size of the ion beam in practice.

Also, the requirement of high transmission of the multi-pass system precludes the use of precursor ion selection devices, i.e. the modulator/deflector 110, which contain grids or wires in the flight path 105 of the ions; although such systems are often used in tandem TOF applications of non-multi-pass systems. A multi-pass precursor ion selection system with even 99% transmission would introduce unacceptably high losses during mass spectrometric analysis due to the repeated passage of the ions through the modulator/deflector 110. For that reason, open systems with no intrusive wires are usually used for the modulator/deflector 110, and the precursor ion selection comes from deflection plates in field free regions, or by switching on and off electrostatic analysers. All these devices have relatively large dimensions in the order of tens of millimetres or even many centimetres. As a result, a larger number of passes is required in order to separate in space adjacent ion packets, and even then only low resolution is achievable.

It is proposed that low resolution precursor ion selection takes place while the ions are within the EST 80, using a modulator/deflector 110 that is not impinged by the ion beam. In that way, ion packets of ions which belong to different passes do not become adjacent and, as a result, a simpler final ion selection process may be adopted. The low resolution separation within the EST 80 can take place with a relatively large modulator/deflector 110 which does not reduce the transmission of the ions at multiple passes. The final mass selection can use, e.g., a Bradbury-Nielsen type wire ion gate and can take place after the ions have been ejected from the EST 80 along the first path. This would allow the system to achieve a higher resolution of ion selection using a smaller number of passes on the EST 80. This is especially useful for MS/MS analysis when only a small number of m/z windows like one or two are to be selected for subsequent fragmentation. In this case, the separation time for precursor ion selection is shortened, the vacuum requirements could be lower, the signal loss is minimised, and the duty-cycle is improved.

Still referring to FIG. 1*a*, there may be occasions where it is desirable to capture those ions of species not initially of interest, for subsequent analysis in further cycles of the spectrometer. This is particularly so when the trap controller 120 has divided the spectrum or set of species identified to be of interest into sub-sets as explained above; those ions which have been separated out, though not of interest in the first cycle, are desirably kept for analysis in subsequent cycles in order to allow the construction of a full mass spectrum, for example. In order to do this, as is seen in FIG. 1*a*, the ions which are not of interest in that particular cycle but which are desired to be kept for analysis in further cycles are deflected along a path 130 towards an optional electric sector device 140, and decelerated. This guides the ejected ions back through further ion optics into the injection trap 60, into which the ions are injected through a second injection trap entrance aperture 150. From there, the ions are stored in the injection trap 60 for subsequent ejection orthogonally through the ion exit aperture 65 back into the electrostatic trap 80 for analysis in a subsequent cycle. If desired, the ions may be subjected to further processing in the injection trap 60 before ejection back into the EST 80 (e.g. fragmentation).

Figure 1B:
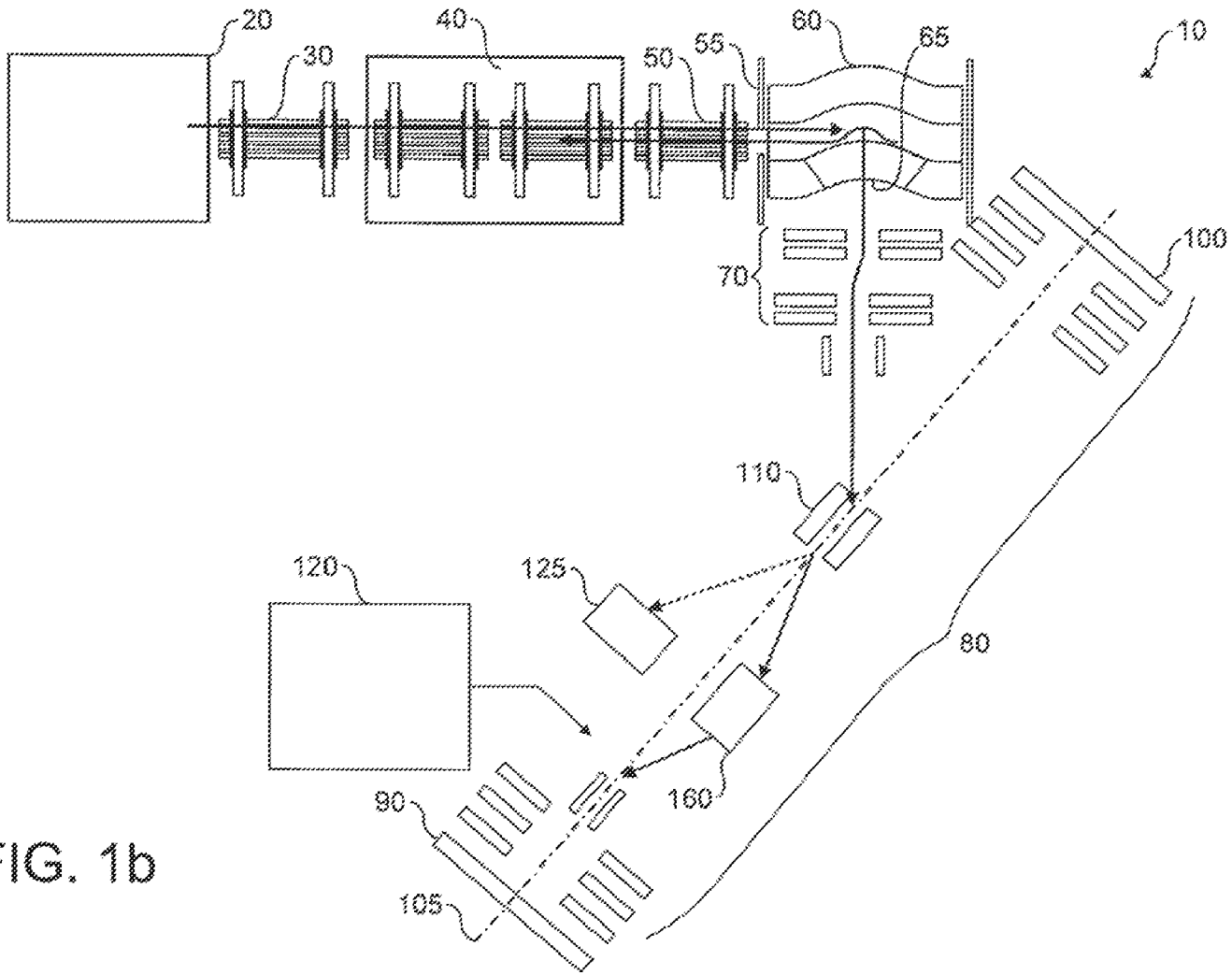
FIG. 1*b* shows another exemplary embodiment of a mass spectrometer including a multi-reflection or closed orbit electrostatic ion trap which is illustrative of the present invention.

Once the ions of species of interest have been separated (that is, once the ions of species of interest are the only ions remaining in the EST 80, usually), the trap controller 120 energises the modulator/deflector 110 when these ions of species of interest are in the vicinity of it so as to divert them out of the oscillating ion path 105 and toward an ion receiver 125. This receiver 125 could be detector, preferably a high dynamic range detector such as an electron multiplier (e.g. a channeltron) with the response time of the detector typically less than 1 ms but usually at least 100 ns. Alternatively, this receiver 125 could be an external fragmentation cell and/or mass spectrometer such as an Orbitrap, time-of-flight (TOF) Fourier Transform Ion Cyclotron Resonance (FT-ICR) mass spectrometer etc. In FIG. 1*a*, such external fragmentation could take place in the pre-trap 40 with subsequent transfer of fragment ions into or in the injection trap 60 followed by their injection into the EST 80, as noted above. An alternative arrangement is shown in FIG. 1*b*. FIG. 1*b* broadly corresponds to FIG. 1*a*; and so like reference numerals are used to denote-like parts. In FIG. 1*b*, a fragmentation cell 160 is located adjacent the ion path 105 to receive ions deflected by the modulator/deflector 110.

The limitations of the response time of the receiver 125 can, however, in accordance with preferred aspects of the present invention, be conveniently overcome by ensuring that the trap controller 120 sequentially diverts each separate ion species to the receiver 125, with a time spacing between each species that is equal to or greater than the response time of the receiver 125. In other words, in the above example where there are three ion species of interest and these three ion species have been separated in the EST 80 in accordance with the above technique, a first of these selected ion species, of mass to charge ratio ($m/z_1$) can be caused to divert to the ion receiver 125 at a time $t_1$, with a second of the three selected ion species, of mass to charge ratio ($m/z_2$) not being deflected toward the ion receiver 125 until a time $t_2$, where $t_2-t_1$ is greater than or equal to the receiver response time. It will of course be understood that, within the tolerances of the EST 80, the ions of species of interest can be allowed to continue to oscillate back and forth along the path 105 many times, whilst one of those ion species is being detected.

Use of a slower detector as receiver 125 allows the dynamic range of detected intensities to be increased greatly. It also allows the use of present-day detection systems from quadrupole or ion trap instruments. These systems are also significantly cheaper than typical data systems for faster detectors (e.g. time-of-flight). The increase of dynamic range of detection makes it possible to reduce detector-related variations and saturation effects and thus make it possible to carry out quantitative analysis. Normally, such analysis is carried out using triple-quadrupole mass spectrometers, frequently using a similar molecule as an internal calibrant. The proposed invention allows storage of pairs of analyte and internal calibrant for each of the species of interest, and subsequent detection of all of them in a single analysis cycle as shown above. An important advantage is that both analyte and its calibrant enter injection trap 60 and EST 80 simultaneously, thus reducing the influence of intermittent ion source variations.

All modes of operation of triple quadrupoles are made possible using the proposed method.

a) Precursor scan. A near-continuous spectrum across a desired mass range can be acquired in small sections. N multiple m/z windows are selected in each cycle and directed to the receiver 125. For example, N could be between 20 and 40. In the next cycle, these m/z window values are incremented in the mass to charge ratio (e.g. by 0.1%) and intensities are acquired for the new windows. The process is repeated until the mass range of interest is covered, and the near-continuous spectrum can be formed from a combination of the data from each cycle.

b) Product scan. For each m/z selected for fragmentation, multiple m/z windows (e.g. N=20-40) are selected in each cycle for fragments and directed to the receiver 125. These m/z windows are stepped from cycle to cycle as described above.

c) Neutral-loss scan. For each m/z selected for fragmentation, only m/z window(s) corresponding to the neutral loss(es) of interest are selected for detection.

For cases a) and b), the improvement of the duty cycle is N relative to a conventional scanning instrument. With a repetition rate of about 1000 Hz, the equivalent scanning speed would be 1000*N m/z windows per second. With a m/z window of e.g. 0.1 Da and N=20, this corresponds to 2000 Da/s for a high-resolution spectrum.

A further advantage of aspects of the present invention is that it is not necessary to extract and detect ions of different species of interest one by one. The trap controller 120 is able to calculate when, despite the different periods of oscillation, ions of two different species of interest will nevertheless coincide at the modulator/deflector 110 due to each having undergone different numbers of oscillations since injection into the EST 80. Thus, two or more species of ions of interest can be ejected for detection simultaneously. Amongst other things, this could be used for analysis of multiple charged states of the same analyte (e.g protein) in order to improve signal-to-noise ratio. Again this is explained in more detail in connection with FIGS. 3*a*-3*c* below.

Figure 2:
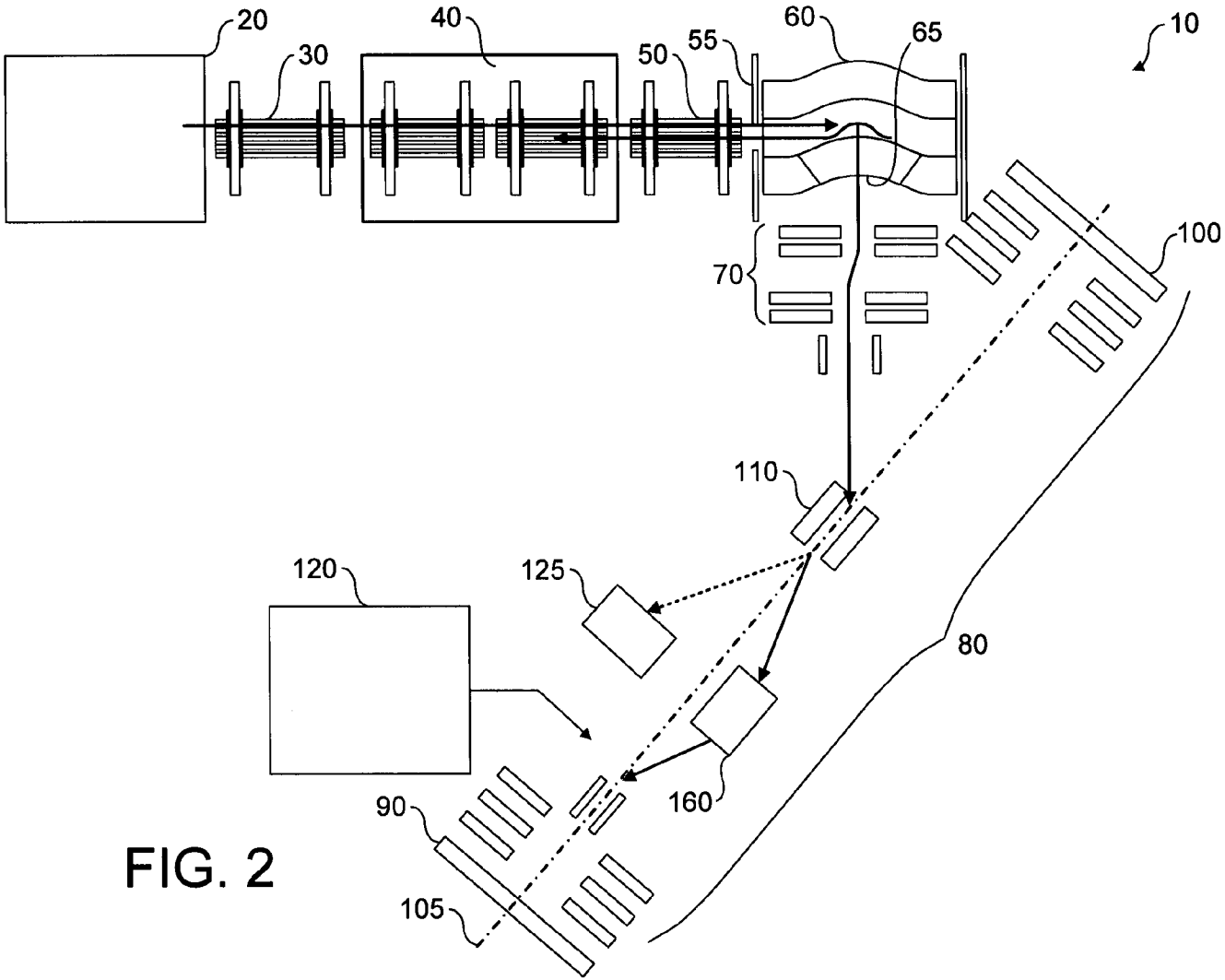
FIGS. 2*a*-2*d* show timing diagrams of pulses applied to the ion deflector of FIG. 1*a* for selective ejection of different ion species.
Figure 2A:
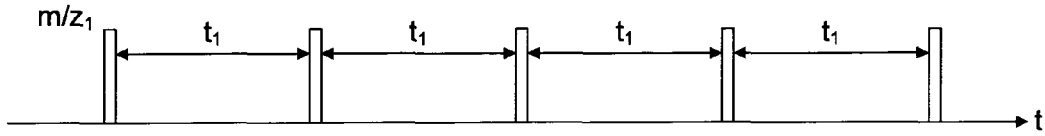
Figure 2B:
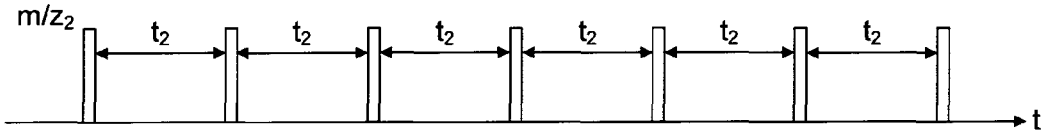
Figure 2C:
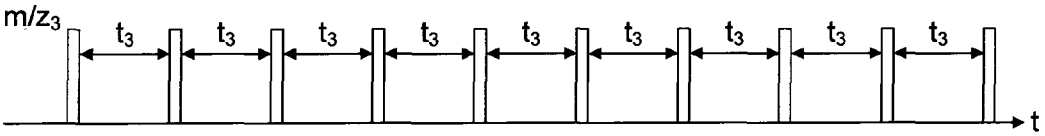
Figure 2D:
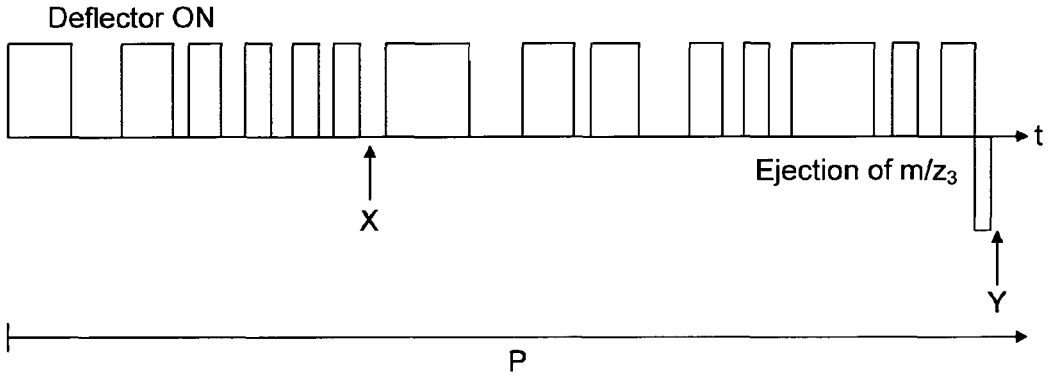

Turning now to FIG. 2*d*, a composite timing diagram is shown schematically, indicating the energization waveform applied by the trap controller 120 to the modulator/deflector 110, where three ion species, $m/z_1$, $m/z_2$, and $m/z_3$ are identified and selected for subsequent analysis. FIGS. 2*a*, 2*b* and 2*c* show the timing diagram for energizing pulses to the modulator/deflector 110, for the cases, respectively, where only ions of $m/z_1$, $m/z_2$, or $m/z_3$ are selected for analysis. As will be explained in further detail below, the composite timing diagram of FIG. 2*d* is the sum of FIGS. 2*a*, 2*b* and 2*c*.

Ions of various ion species are injected into the EST 80. The three ion species of interest, $m/z_1$, $m/z_2$ and $m/z_3$ are identified for separation from the remaining, unwanted ion species. The trap controller 120 can calculate the times at which each of the three ion species $m/z_1$, $m/z_2$ and $m/z_3$ will pass the modulator/deflector 110, because each of these ion species, separately, has a distinct period of oscillation. As shown in FIG. 2*a*, for example, ions of a first species, of mass to charge ratio $m/z_1$, has a period of oscillation of $t_1$ (that is, ions of that species pass the modulator/deflector 110 at times $T'+t_1$, $T'+2t_2$, $T'+3t_1$). As shown in FIG. 2*b*, on the other hand, ions of a second ion species $m/z_2$ have a period of oscillation $t_2$ so that ions of that species pass the modulator/deflector 110 at times $T''+t_2$, $T''+2t_2$, $T''+3t_2$, etc. Finally as shown in FIG. 2*c*, ions of the third ion species $m/z_3$ pass the modulator/deflector 110 with a period of oscillation $t_3$, that is, at times $T'''+t_3$, $T'''+2t_3$, $T'''+3t_3$ etc. As a consequence of the different periods of oscillation of the three ion species, $t_1$, $t_2$, and $t_3$, it will of course be appreciated that ions of those different ion species pass the modulator/deflector 110 a different number of times over an ion separation period P (see FIG. 2*d*). In the exemplary embodiments, the ions of the first mass to charge ratio $m/z_1$ pass the modulator/deflector 110 five times over that time P, whereas the ions of species $m/z_2$ pass the modulator/deflector 110 seven times (FIG. 2*b*) and the ions of the third ion species $m/z_3$ pass it ten times (FIG. 2*c*).

As explained above, it is preferable though not essential that the modulator/deflector 110 is normally energized, with the modulator/deflector 110 being de-energised only when the ions of the three chosen ion species are in the vicinity of it. Comparing FIGS. 2*a*, 2*b* and 2*c* with FIG. 2*d* (where each of the timing diagrams has a common time axis scale and a common starting point), it will be seen that the modulator/deflector 110 is de-energized just before the ions of the third ion species, having mass to charge ratio $m/z_3$ arrive in the vicinity of that modulator/deflector 110. The ions of the second species $m/z_2$ have a slightly longer period of oscillation $t_2$ but are, during the first of the oscillations shown in FIGS. 2*a* to 2*d*, sufficiently close to the ions of the third species that the modulator/deflector 110 remains de-energized. Likewise, for the first ion species, of mass to charge ratio $m/z_1$, having a still longer period of oscillation $t_1$, these ions arrive at the modulator/deflector 110 immediately after the ions of the second ion species in the first oscillation shown in FIGS. 2*a* to 2*d*. Thus the modulator/deflector 110 remains de-energized to allow the ions of the first species to pass through and continue along the ion path 105 (FIG. 1*a*).

As soon as the ions of the first ion species have passed the modulator/deflector 110, it is re-energized so that any ions of any other ion species than the three ion species $m/z_1$, $m/z_2$ or $m/z_3$ are diverted out of the ion path 105 for removal from the EST 80 or discarding, as explained above.

After a further time period, the modulator/deflector 110 is de-energized once more since the trap controller 120 has calculated that ions of the third mass to charge ratio $m/z_3$ will be arriving at the modulator/deflector 110 again (FIG. 2*c*). However, this time, the ions of the second and first mass to charge ratios are sufficiently separated from the ions of the third mass to charge ratio that the modulator/deflector 110 is re-energized before ions of the second species arrive, somewhat later.

After a few oscillations, however, the significantly different periods of oscillation of the ions of the different species of interest means that ions of a one of the species catch up with ions of a different of the species, owing to a different number of oscillations completed. Thus, at the point X marked on Figure d, it can be seen that the ions of the second and third species have both arrived at the modulator/deflector 110 at approximately the same time, even though the ions of the third species have undergone one more round trip in the EST 80 than have the ions of the second species.

Once sufficient time has elapsed so that the three desired ion species have been separated from the remaining, undesired ion species (that is, in the preferred embodiment, where all but the three ion species $m/z_1$, $m/z_2$ and $m/z_3$ have been removed from the EST 80), the trap controller 120 can cause a different voltage to be applied to the modulator/deflector 110 so as to divert ions of one or more of the species of interest out of the ion path 105 towards the receiver 125. As shown in FIG. 2*d*, at time Y, the trap controller 120 causes the voltage applied to the modulator/deflector 110 to be of opposite polarity to that normally applied to remove the unwanted ion species. This deflects only ions of the third ion species $m/z_3$ out of the ion path 105 towards the receiver 125.

Nevertheless, it will be appreciated from the foregoing that, by appropriate selection of the time at which the modulator/deflector 110 is energized with this opposite polarity voltage, it is possible to eject more than one ion species simultaneously. For example, if, instead of de-energizing the modulator/deflector 110 at the time X indicated in FIG. 2*d*, an opposite polarity voltage such as is shown at time Y, though of longer time span, were applied to the modulator/deflector 110, then ions of both the second and third ion species would be ejected simultaneously from the ion path 105 towards the ion receiver 125. Since the period of oscillation of all of the ions of interest is known, the trap controller 120 is able to calculate in advance a time when ions of one, some or all of the ion species of interest, in any combination, will be substantially coincident at the modulator/deflector 110.

A further consequential advantage of the technique illustrated above is that it permits the diversion of ions of species of interest to the ion receiver 125 at any time following the separation of the ions of interest from those not of interest. More particularly, this allows the ions of the species of interest to be diverted to the ion receiver 125 in accordance with the techniques described above, to permit the ion receiver 125 properly to detect the ions in accordance with its response timer before ions of different species of interest are directed towards it. In other words, the time between ejection of, say, the ions of the third ion species of interest $m/z_3$ and the time, subsequently, of ejection of the ions of the second species $m/z_2$ can be chosen to be greater than the response time of the receiver 125. If the receiver 125 is an electron multiplier, for example, this time might be of the order of 10 microseconds. Thus, by knowledge of the times at which the different ion species of interest will be passing the modulator/deflector 110, the trap controller 120 can calculate an ion ejection strategy that ensures that each of the ions of the species of interest are directed towards the ion receiver 125 for separate detection at time intervals greater than the response time of the ion receiver 125.

Figure 3A:
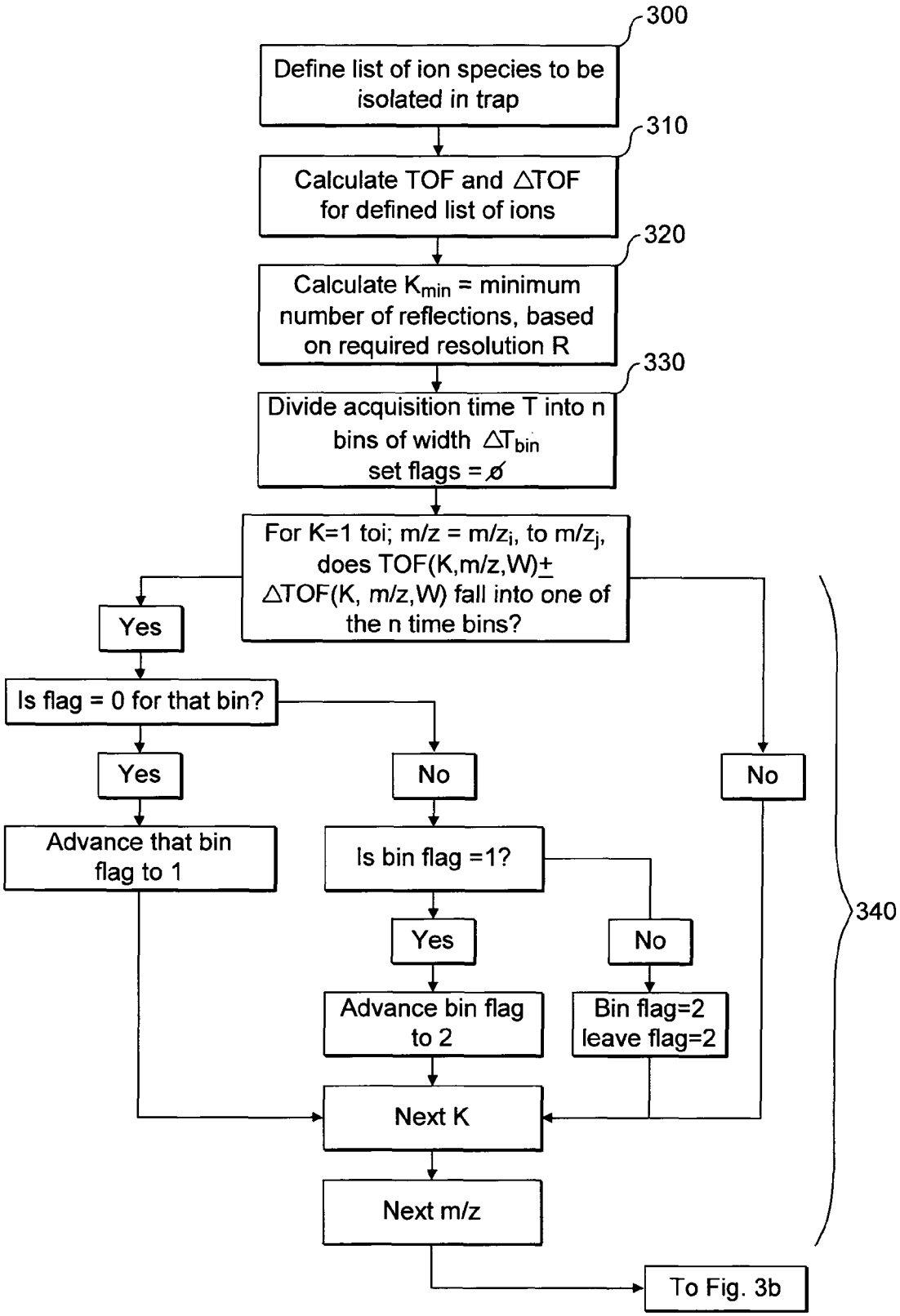
FIGS. 3*a*, 3*b* and 3*c* together constitute a flow diagram illustrating an algorithm for constructing the timing of the sequence of pulses shown in FIGS. 2*a*-2*d*.
Figure 3B:
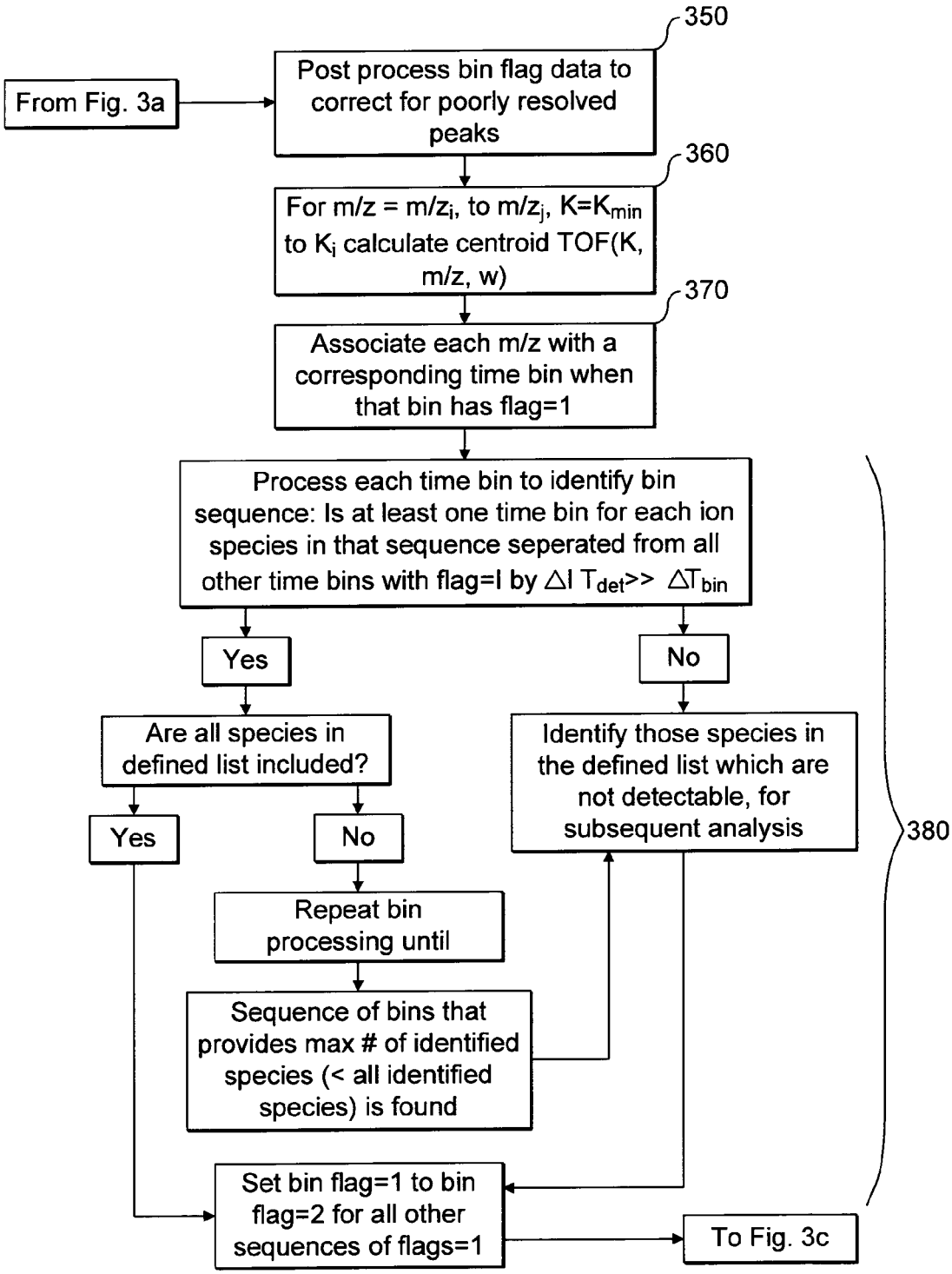
Figure 3C:
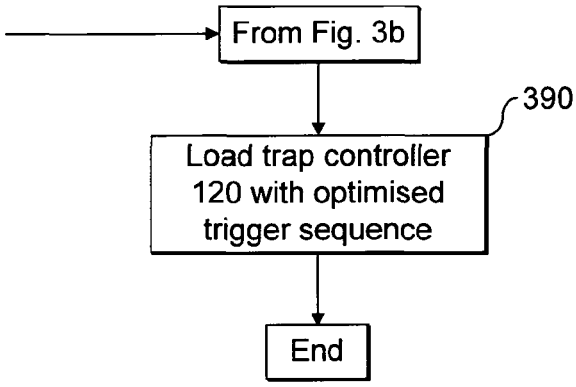

Turning now to FIGS. 3*a* to 3*c*, a flow chart is shown which illustrates a preferred embodiment of an algorithm for permitting multiple ion isolation and detection.

At step 300, a user or a data dependent software is able to define a list of ion species to be isolated within the EST 80. This list of all possible ions that could be isolated will, typically, be constrained by the range of mass to charge ratios that can be injected into the EST 80 in a single fill or, alternatively, the mass range of ions formed through ionisation within the EST 80. However, as a further extension, rather than constraining the list of ion species that may be isolated, that is, the "menu" of ion species in accordance with what is available in the EST 80, the trap controller 120 could instead control the rest of the mass spectrometer 10, to define the mass range of ions to be injected into the EST 80 (or formed in it) as a result of the ions selected by the user for analysis.

Once a list of ion species of interest has been identified by the user, at step 310 the trap controller 120 calculates the time-of-flight as a function of the number of reflections, K, the mass to charge ratio of each identified ion species, and additional variables W such as, for example, the number of ions injected into the trap. Mathematically, this may be expressed as TOF (K,m/z,W). The trap controller also calculates the spread in the times of flight of each identified ion species, mathematically expressed as ΔTOF (K,m/z,W). In both cases, the values TOF and ΔTOF may be obtained using calibration/theoretical data, as has been described above. Next, at step 320, the minimum number of reflections $K_{min}$ is calculated, depending upon the required resolution R. Again, mathematically, this may be expressed as $K_{min}$ (R,m/z,W).

The entire duration of acquisition, T, is then split into "bins", each of width dT. The width of each bin, dT, is related to the switching time of the modulator/deflector 110 and may, for example, be determined upon the basis of the rise time from 10 to 90% of the peak deflection voltage. As shown at step 330, each bin is initiated with a zero value (the meaning of the flag value will be explained further below).

At step 340 of FIG. 3*a*, a first repeating loop 340 is shown. The trap controller 120 cycles through this loop for each value of K from 1 to i, and for each mass to charge ratio of the selected ion species ($m/z_1$ to $m/z_j$). In each case, if TOF (K,m/z,W)+/−ΔTOF (K,m/z,W) falls into one of the n time bins, then that time bin is assigned a value 1, if the flag in that bin is, at that time, previously zero, and, if the bin flag is already set at 1 (because the time bin has already been set from zero to 1 as a result of a different TOF (K,m/z,W) +/−ΔTOF (K,m/z,W) falling within that bin), then the bin flag is advanced to 2. However, if the bin flag is already set at 2, it is not further advanced beyond that. The presence of a flag 2 in a particular time bin indicates interference between two ion species, that is, indicates where two different ion species would, at a certain time, coincide at the modulator/deflector 110.

Once the loop 340 has concluded, the bin flag data is post-processed, at step 350 (FIG. 3*b*) to correct for poorly resolved peaks. For example, when two different non-zero values (that is, 1 or 2) follow each other, or are separated by only one zero, then in this case, all the time bins within this region of poor resolution are assigned a flag value 2.

At step 360, a second loop is initiated. For each of the ion species selected by the user ($m/z_1$ to $m/z_j$), and for all K from a minimum value $K_{min}$ up to $K_i$, the centroid TOF (K,m/zW) is calculated, up to the time T (the duration of acquisition). At step 370, the trap controller 120 then associates each m/z with a corresponding time bin dT when that bin has a flag of 1.

A final processing loop 380 is then initiated by the trap controller 120. In general terms, this processing loop has as an aim the identification of an optimized subset of the list of all ion species to be isolated, with periods of oscillation (or some other parameter) separated sufficiently to match the resolution of receiver 125 (or of a further stage of ion processing). For example, not all the species the user is interested to measure may be able to be separated sufficiently within the trapping time T to provide an adequate time spacing between them. This processing loop 380 determines which species can be sufficiently separated and so which can be measured in one filling of the EST 80. Of course, as described above, any ions which are of species that, ultimately, the user wants to analyse, can be separated out and stored elsewhere for injection back into the EST 80 in subsequent cycles. Thus, the processing loop 380 may sub-divide the group of, say, twenty ion species of interest into four sub-sets of five ion species, each of which sub-sets has maximally separated periods of oscillation of the ions in it. It is to be stressed that the number of ion species in each sub-set, the number of sub-sets and so forth is entirely a matter of design choice depending upon, but not limited to, such parameters as resolution of the mass spectrometer 10, acceptable overall processing times of the ion, sample abundance and so forth.

Looking in more detail at the processing loop 380, it is seen in FIG. 3*b* that each time bin is processed in such a way as to identify a time bin sequence wherein, if possible, at least one time bin for each ion species having a flag set to 1, is separated from all other time bins having a flag equal to 1 by an amount $dT_{det}$ which is the time resolution of the detector and which might be much greater than the width of each time bin. It is unlikely that all user selected species will be able to be separated sufficiently in time, in which case as many as possible will be found using this method. Once the ejection time bins for the successful species are known, all other bins containing flag 1 are set to flag 2, to continue transmitting the ions for their later ejection onto the detector. It may be necessary to try various different combinations to maximize the number of ions that can be detected within the sub-set of the total list of ion species of interest. If it is determined that none of the combinations allow detection of at least one ion species from the list inputted by the user, then these species are left for later interrogation in subsequent cycles.

Finally, once the processing loop 380 has concluded and the optimized grouping of ion species has been identified, this final sequence is used to create the trigger sequence (such as the one shown in FIG. 2*d*) that fires the modulator/deflector 110. In particular, a zero in the final sequence will trigger deflection onto a beam absorber (dump) which is not shown in FIG. 1. A "1" triggers deflection onto the receiver 125. Finally a "2" means that no deflection should take place, that is, the ion should be transmitted without deflection.

As an alternative, of course, deflection to the receiver 125 could be performed by a second modulator/deflector 110 (not shown in FIG. 1*a*). In this case, the signals identified above could be split into two sequences of triggers, each having only zeros and 1 s.

Although a specific embodiment of the present invention has been described, it is to be understood that various modifications and improvements could be contemplated by the skilled person.

What is claimed is:

1. A multi-reflection or closed orbit ion trap assembly, comprising:

an ion trap;

an electrode arrangement including an ion gate, the ion gate being switchable between a first gating state wherein ions, when following a path within the ion trap, are directed along a first ion path, and a second gating state wherein ions, when following a path within the ion trap, are directed along a second ion path; and a system controller arranged to permit identification, from within a plurality of species of charged particles introduced into, or formed within the ion trap, a plurality n(≧2) of ion species of interest each of which n identified ion species undergoes substantially isochronous oscillations or orbits along the path within the ion trap, the oscillations or orbits having period characteristic of the respective mass to charge ratio $m/z_n$ of that species, and which period is distinct for each of said n identified species, the system controller being further arranged to switch the ion gate into the first gating state at a plurality of times $T_x$, a first subset of which times, $T_a$(a≧1) being determined by the characteristic period of ions of a first of the n identified species of interest, a second subset of which times, $T_b$(b≧1) being distinct from the first subset and being determined by the different characteristic period of ions of a second of the n identified species of interest, and so forth for any further (n−2) of the n identified species of interest;

whereby the ions of those species identified to be of interest are separated from those ions not so identified.

2. The ion trap assembly of claim 1, wherein, during a first time period, the system controller is arranged to switch the ion gate between the first gating state when the ions of the n identified species are in the vicinity of the ion gate, and the second gating state when it is determined by the controller that ions of species not identified for analysis are in the vicinity of the ion gate.

3. The ion trap assembly of claim 2, wherein the system controller is arranged to determine when a single one of the n identified species is in the vicinity of the ion gate, during a second time period, and to switch the ion gate into an ion detection state at that moment.

4. The ion trap assembly of claim 3, wherein the ion gate comprises an excitation electrode and a power supply therefor, the system controller being arranged to cause the power supply to selectively energize the ion gate so as to place it in the second gating state in which those ions not identified for analysis are directed along the second ion path.

5. The ion trap assembly of claim 4, wherein the system controller is arranged to cause the power supply to deenergize the excitation electrode when the ions of the n identified species are in the vicinity of the ion gate so as to allow passage through the ion gate of those n ion species substantially without excitation.

6. The ion trap assembly of claim 2, wherein the system controller is arranged to determine when a plurality of different species will coincide at the ion gate, during a second time period, as a consequence of each of those species, despite having different characteristic periods of oscillation, having undergone different numbers of oscillations in the ion trap, the system controller being further arranged to switch the ion gate into an ion detection state at that moment.

7. The ion trap assembly of claim 2, wherein the system is arranged to control the ion gate so that the ions of the n identified ion species are directed along the first ion path towards a part of the electrode arrangement which in turn causes the ions of the n identified ion species to maintain their oscillatory or orbital motion within the ion optical system but wherein the ions not of the n identified species are instead directed along the second ion path towards an ion optical system which prevents those ions not of the n identified species from maintaining oscillatory or orbital motion in the ion trap.

8. The ion trap assembly of claim 7, wherein the ion gate is arranged to cause those ions not of the n identified species which are directed along the second ion path are allowed to exit the ion trap or strike a part of the ion trap such that they become lost.

9. A mass spectrometer comprising:

an ion trap;

an electrode arrangement including an ion gate, the ion gate being switchable between a first gating state wherein ions, when following a path within the ion trap, are directed along a first ion path, and a second gating state wherein ions, when following a path within the ion trap, are directed along a second ion path; and a system controller arranged to permit identification, from within a plurality of species of charged particles introduced into, or formed within the ion trap, a plurality n(≧2) of ion species of interest each of which n identified ion species undergoes substantially isochronous oscillations or orbits along the path within the ion trap, the oscillations or orbits having period characteristic of the respective mass to charge ratio $m/z_n$ of that species, and which period is distinct for each of said n identified species, the system controller being further arranged to switch the ion gate into the first gating state at a plurality of times $T_x$, a first subset of which times $T_a$(a ≧1) being determined by the characteristic period of ions of a first of the n identified species of interest, a second subset of which times, $T_b$(b≧1) being distinct from the first subset and being determined by the different characteristic period of ions of a second of the n identified species of interest, and so forth for any further (n−2) of the n identified species of interest; and an ion detection arrangement, the system controller being arranged to switch the ion gate into an ion detection state once the n identified ion species have been separated from those not identified, at a time when it is determined by the system controller that m of the n species of trapped ions will be in the vicinity of the ion gate ($m \geqq 1$; $m \leqq n$);

wherein the system controller is further arranged to direct the m ion species in the vicinity of the ion gate towards the ion detection arrangement for detection there when in the ion detection state.

10. The mass spectrometer of claim 9, wherein the system controller is configured to direct the said m ion species towards the ion detection arrangement in a first detection cycle, and to direct $q(q \geqq 1, q \leqq (n-m))$ of the remaining $(n-m)$ of the n ion species towards the ion detection arrangement for detection there in a second detection cycle; and wherein there is a time separation $\Delta t$ between the first and second detection cycles which exceeds a response time of the ion detection arrangement.

11. The mass spectrometer of claim 9, wherein the controller is configured to receive an input from a user indicative of a plurality, P, of ion species to be analysed from the plurality of species of charged particles introduced into, or formed within the ion optical system, the system controller being arranged then to identify, on the basis of an ion species selection optimization algorithm, those n ion species to be processed in a first ion separation cycle.

12. The mass spectrometer of claim 11, wherein the ion species selection optimization algorithm identifies the n ion species to be processed in the first ion separation cycle based upon or related to the amount of separation in the periods of oscillation or orbit of the ions of the p ion species to be analysed.

13. The mass spectrometer of claim 9, wherein the ion detection arrangement is positioned externally of the ion optical system.

14. The mass spectrometer of claim 9, wherein the ion detection arrangement is positioned within or adjacent the electrode arrangement of the ion trap.

15. The mass spectrometer of claim 9, further comprising an ion source for generating charged particles.

16. The mass spectrometer of claim 15, further comprising an ion storage and injection device positioned between the ion source and the ion trap, the ion storage and injection device being arranged to receive and store charged particles from the ion source, and subsequently to inject the said plurality of charged particles into the ion trap.

17. The mass spectrometer of claim 9, further comprising a mass analysis arrangement for analysing ions of the ion species of interest.

18. The mass spectrometer of claim 17, wherein the mass analysis arrangement includes a fragmentation device arranged to receive ions of species of interest from the ion trap, to fragment at least some of those ions, and to eject the resultant ions, including fragment ions, to a subsequent mass analyser.

19. The mass spectrometer of claim 18, wherein the fragmentation device contains multiple channels, at least one of which receives not more than one species of interest.

20. The mass spectrometer of claim 18, wherein the fragmentation device is arranged to store ions, and/or includes an ion storage arrangement.

21. The mass spectrometer of claim 18, further comprising a mass analyser downstream of the fragmentation device, the mass analyser being one or more of an Orbitrap mass spectrometer, a time-of-flight (TOF) mass spectrometer, and/or an FT-ICR mass spectrometer.

22. A method of acquiring a continuous or near-continuous mass spectrum across a desired m/z range containing a plurality of ion species of interest by operating a multi-reflection or closed orbit ion trap assembly, comprising the steps of:

(a) identifying $n(\geqq 2)$ ion species from a superset of ion species injected into, or formed within, an ion trap, each of which identified species undergoes substantially isochronous oscillations or orbits along a path within the ion trap, the oscillations or orbits having a period characteristic of the respective mass to charge ratio $m/z_n$ of that species and which period is distinct for each of the n identified species;

(b) switching an ion gate located in or adjacent the ion trap between a first gating state in which ions of the identified species passing along the path within the ion trap are directed along a first ion path for further processing, and a second gating state in which ions not of the identified species passing along the path within the ion trap are directed along a second, different path for further storage or disposal;

wherein the ion gate is switched into the said first gating state at a plurality of times $T_x(x=1, 2, \ldots)$, a first subset of which times, $T_a(a \geqq 1)$ being determined by the characteristic period of ions of a first of the n identified species, a second subset of which times, $T_b(b \geqq 1)$ being distinct from the first subset and being determined by the different characteristic period of ions of a second of the n identified species, and so forth for any further $(n-2)$ of the n identified species; and repeating steps (a) and (b) for a second superset of ion species injected into, or formed, within, the ion trap thereby to identify $p(\geqq 2)$ ion species different to the n ion species identified in the first superset with respective changes to the gating times $T_a$, $T_b$ and so forth.

23. The method of claim 22, wherein a maximum number of oscillations or orbits is specified, and wherein ions are identified from each superset according to whether they may be resolved from ion species of adjacent $m/z_n$.

24. The method of claim 22, wherein the ions of the identified species of each superset is directed along the first ion path to a device for fragmenting.

25. The method of claim 22, wherein the ions of the identified species of each superset is directed along the first ion path to a device for detection.

26. The method of claim 22, wherein each superset of ion species is injected into the ion trap from an ion source.

27. The method of claim 22, wherein ions not of the identified species are directed along the second path for further storage and subsequently reintroduced into the ion trap as the next superset of ion species.

28. A method of operating a multi-reflection or closed orbit ion trap assembly, comprising the steps of:

(a) identifying a plurality n ion species of interest from a superset of ion species injected into, or formed within, an ion trap, each of which identified species undergoes substantially isochronous oscillations or orbits along a path within the ion trap, the oscillations or orbits having a period characteristic of the respective mass to charge ratio $m/z_n$ of that species and which period is distinct for each of the said n identified species;

(b) switching an ion gate located in or adjacent the ion trap between a first gating state in which ions of the identified species passing along the path within the ion trap are directed along a first ion path, and a second gating state in which ions not of the identified species passing along the path within the ion trap are directed along a second, different path;

wherein the ion gate is switched into the first gating state at a plurality of times $T_x(x=1, 2, \ldots)$, a first subset of which times, $T_a(a \geqq 1)$ being determined by the characteristic period of ions of a first of the n identified species of interest, a second subset of which times, $T_b(b \geqq 1)$ being distinct from the first subset and being determined by the different characteristic period of ions of a second of the n identified species of interest, and so forth for any further (n−2) of the n identified species of interest;

whereby the ions of those species identified to be of interest are separated from those ions not so identified.

29. The method of claim 28, wherein the ion gate is a selectively actuatable ion deflector, the step (b) of switching the ion gate comprising deactuating the deflector at the times T so as to create the first gating state in which the ions of the identified species are directed along the first ion path which is in a substantially undeflected direction relative to the direction of arrival at the deflector, and actuating the deflector at other times so as to create the second gating state in which the ions which are not of the identified ion species are directed along the second ion path which is deflected away from the first ion path.

30. The method of claim 28, wherein the ion gate is a selectively actuatable ion deflector, the step (b) of switching the ion gate comprising actuating the deflector at the times $T_x$ so as to create the first gating state in which the ions of the identified species are directed along the first ion path, and deactuating the deflector at other times so as to create the second gating state in which ions not of the species of interest are directed along the second ion path which is in a substantially undeflected direction relative to the direction of arrival at the deflector, and wherein the first ion path is deflected away from the second ion path.

31. The method of claim 28, wherein the ion gate is a selectively actuable ion deflector, the step (b) of switching the ion gate comprising deactuating the deflector at the times $T_x$ so as to create the first gating state in which the ions of the identified species are directed along the first ion path, and actuating the deflector at other times so as to create the second gating state in which the ions which are not of the identified ion species are directed along the second ion path, wherein one of the first and second ion paths is in a substantially deflected direction relative to the direction of arrival at the detector and the other of the first and second ion paths is in a substantially undeflected direction relative to the direction of arrival at the detector, further comprising ejecting those ions directed along the second ion path from the trap.

32. The method of claim 31, wherein those ions directed along the said second ion path are discarded.

33. The method of claim 32, wherein the ions are continuously discarded.

34. The method of claim 31, further comprising capturing at least some of those ions directed along the said second ion path.

35. The method of claim 34, wherein the step of capturing at least some of the ions comprises storing those ions in an ion storage device which is external to the multi-reflection or closed orbit trap.

36. The method of claim 35, further comprising, in a second analysis cycle, (c) reintroducing into the multi-reflection or closed orbit trap at least some of those ions stored externally of the trap and which were not previously of the identified ion species; and (d) repeating step (b) in respect of the ions reintroduced into the said trap from the external storage device.

37. The method of claim 36, wherein the step of identifying a plurality n of ion species of interest comprises (e) selecting from the superset of ion species, a plurality p(>n) of ion species for analysis;

(f) identifying from that plurality p of ion species a subset of n ion species to be processed in the first analysis cycle;

(g) separating out the ions of the n identified species from the ions of the remaining (p−n) species; and (h) reintroducing to the ion trap, ions of the (p−n) species for analysis in one or more subsequent analysis cycles.

38. The method of claim 37, wherein the step (f) of identifying the subset of n ion species comprises selecting the ion species to constitute that subset using an ion separation optimization criterion.

39. The method of claim 38, wherein the ion separation optimization criterion is based upon or related to the amount of separation between the characteristic periods of the different ions in the selected plurality p of ion species.

40. The method of claim 39, wherein the ion separation optimization criterion seeks to maximize the separation in ion oscillation or orbit periods of the ions of the n identified ion species.

41. The method of claim 28, wherein, in respect of an individual one of the plurality of identified ion species, the ion gate is switched into the said first gating state a plurality of times, each of which is at a time related to the characteristic period of that particular identified ion species.

42. The method of claim 28, further comprising detecting the identified ion species.

43. The method of claim 42, further comprising directing the ions of the identified ion species towards an ion receiver such as an ion detector once they have been at least partially separated from those not identified.

44. The method of claim 43, wherein the step of directing the ions of the identified ion species towards an ion receiver comprises switching the ion gate into a third gating state in respect of those ions of at least one of then identified species, at a time when ions of the at least one identified species that is to be detected are in the vicinity of the said ion gate, the third gating state causing the ions to be directed towards an ion detection arrangement.

45. The method of claim 44, wherein, despite the distinct characteristic periods of each of the n identified ion species, two or more of the ion species arrive at the ion gate substantially simultaneously, as a result of the ions of each of the distinct ion species undergoing different numbers of oscillations within the ion trap, the method further comprising:

(j) determining a time when m ($\geqq 2$ but $\leqq n$) of the n identified ion species will arrive at the ion gate substantially simultaneously, based upon the characteristic periods of those identified ions; and (k) switching the ion gate into the third gating state at the time when it is determined that both or each of the m identified ion species are in the vicinity of the ion gate, so as to direct both or each of the m identified ion species simultaneously toward the ion detection arrangement.

46. The method of claim 15 further comprising:

carrying out steps (j) and (k) in respect of the m identified species during a first time interval; and repeating the steps (j) and (k) in respect of a further p($\geqq 2$) of the n identified species, during a second time interval subsequent to the first time interval.

47. The method of claim 45, further comprising:

carrying out the steps (j) and (k) in respect of the m identified species during a first time interval; and identifying a time during a second time interval subsequent to the said first time interval, said identified time being based upon the characteristic period of the identified ion species, wherein a single one of the n identified ion species, not being one of the m ion species, is in the vicinity of the ion gate;

switching the ion gate into the third gating state in respect of the single one of then identified ion species, during the second time interval and when the ions of that species are in the vicinity of the ion gate, so as to direct only those ions toward the said ion detection arrangement.

48. The method of claim 47, wherein there is a time separation Δt between the first and second time intervals, the time separation Δt exceeding a response time of the said ion detection arrangement, and further wherein the ions arrive at the ion detection arrangement as a series of ion packets, the width of each is less than the response time of the ion detection arrangement but separation of which exceeds said response time.

49. The method of claim 48, wherein the response time of the ion detection arrangement is used for quantitative mass spectrometric analysis of at least one ion species of interest and at least one other ion species produced from an internal calibrant.

50. The method of claim 45, further comprising:

(l) identifying a time, based upon the characteristic periods of the identified ion species, wherein only a chosen one of the n identified species is in the vicinity of the ion gate; and (m) switching the ion gate into the third gating state in respect of those ions of that chosen one of the n species, when they are in the vicinity of the ion gate, so as to direct only those said ions toward the ion detection arrangement.

51. The method of claim 50, further comprising:

carrying out steps (l) and (m) in respect of the single identified ion species during a first time interval;

repeating the steps (l) and (m) in a second time interval subsequent to the first time interval and in respect of a different one of the n identified species.

52. The method of claim 50, further comprising:

carrying out steps (l) and (m) in respect of the single identified ion species during a first time interval;

determining a time, during a second time interval subsequent to the first time interval, during which $m(\geqq 2; m \leqq n)$ of the n identified ion species will arrive at the gating location substantially simultaneously, based upon the characteristic periods of those n identified ions; and switching the ion gate into the third gating state at the time when it is determined that both or each of the m identified ion species are in the vicinity of the ion gate, so as to direct both or each of the m identified ion species simultaneously toward the ion detection arrangement.

53. The method of claim 28, further comprising carrying out at least one further step of analysis on those ions of the identified species or at least some of those ions not of the identified species.

54. The method of claim 53, further comprising fragmenting at least some of those ions of the identified species or at least some of those ions not of the identified species.

55. The method of claim 54, further comprising fragmenting at least some of those ions of the identified species or fragmenting at least some of those ions not of the identified species and, in a second analysis cycle, (c) reintroducing into the ion trap at least some of fragmented ions; and (d) repeating step (b) in respect of these ions.

56. The method of claim 54, wherein the step of fragmenting the ions is followed by storing those ions in an ion storage device which is external to the ion trap.

57. The method of claim 53, wherein the at least one further step of analysis includes directing the ions of the ion species of interest into a separate mass analyser arrangement.

58. The method of claim 57, wherein the step of directing the ions of the ion species of interest into a separate mass analyser arrangement includes directing the ions into a fragmentation device, carrying out fragmentation of at least some of those ions, and then carrying out at least one further stage of mass analysis on those ions.

59. The method of claim 58, wherein the step of carrying out at least one further stage of mass analysis is selected from the list comprising analysing the ions in an Orbitrap device; analysing the ions in a time-of-flight (TOF) mass analyser; and analysing the ions in a Fourier transform ion cyclotron resonance (FT-ICR) mass analyser.

60. The method of claim 58, wherein, in a first analysis cycle, a first set of ions of ion species of interest is directed into the fragmentation cell, at least some of which are then fragmented and then passed onto the said further stage(s) of mass analysis, and wherein in a second analysis cycle, a second set of ions of ion species of interest is directed into the fragmentation cell, at least some of which are also then fragmented and then passed on to the said further stage(s) of mass analysis, and wherein the separation, in time, between the first and the second sets of ions is greater than the residence time thereof in the fragmentation device, so as to permit sequential analysis of parent ions in the mass analyser arrangement.

* * * * *